United States Patent [19]

Sakuichi et al.

[11] Patent Number: 4,685,810

[45] Date of Patent: Aug. 11, 1987

[54] MIXING APPARATUS FOR POWDERED OR GRANULAR MATERIALS

[75] Inventors: Sakakibara Sakuichi, Kobe; Tokuda Yoshiaki, Kyoto; Nagai Tamio, Suita; Takino Yorinobu, Yao; Arai Tomiro, Hirakata, all of Japan

[73] Assignees: Matsui Manufacturing Co., Ltd.; House Food Industrial Company Limited, both of Osaka, Japan

[21] Appl. No.: 779,658

[22] Filed: Oct. 21, 1985

Related U.S. Application Data

[63] Continuation-in-part of Ser. No. 620,154, Jun. 13, 1984, abandoned.

[30] Foreign Application Priority Data

Jun. 14, 1983 [JP] Japan ..... 58-90623[U]

[51] Int. Cl.[4] ..... B01F 15/02; B01F 13/02

[52] U.S. Cl. ..... 366/150; 366/3; 366/10; 366/101

[58] Field of Search ..... 366/3, 5, 11, 101, 102, 366/107, 132, 141, 150, 160, 165, 183, 10, 151; 406/24, 25, 32, 90, 91, 94, 95, 124, 125, 126

[56] References Cited

U.S. PATENT DOCUMENTS

| | | | |
|---|---|---|---|
| 2,565,946 | 8/1951 | Bozieh | 406/25 |
| 3,251,583 | 5/1966 | Mason | 366/10 |
| 3,463,460 | 8/1969 | Taylor | 366/3 |
| 3,727,985 | 4/1973 | Reuter | 406/25 |
| 4,444,508 | 4/1984 | Kreuer | 366/163 |

FOREIGN PATENT DOCUMENTS

| | | | |
|---|---|---|---|
| 1293650 | 4/1961 | France | 406/24 |
| 1106082 | 3/1965 | United Kingdom | 406/24 |
| 2038750A | 7/1980 | United Kingdom | 406/95 |

*Primary Examiner*—Robert W. Jenkins

*Attorney, Agent, or Firm*—Koda and Androlia

[57] ABSTRACT

An apparatus for mixing and dispersing powdered or granular materials into a liquid solvent with a pneumatic transport means including a supply hooper, a pressure vessel which receives granular materials from the hopper for pressurization, a granular material transport pipe attached at one end to the discharge portion of the pressure vessel, a pneumatic force source for feeding the granular materials under pressure through the granular material transport pipe to a mixing tank accommodating the liquid solvent therein. The granular material transport pipe is connected to the mixing tank in an upward or lateral direction at the level below the surface of the liquid solvent contained in the mixing tank. With this structure the granular material is kept from scattering towards the upper portion of the mixing tank, making the operation more sanitary. Further, since the granular material is fed into the solvent contained in the mixing tank by pressurized feeding gas, a uniform mixing may be achieve, and the formation of undissolved powder lumps or flocs can be prevented.

6 Claims, 1 Drawing Figure

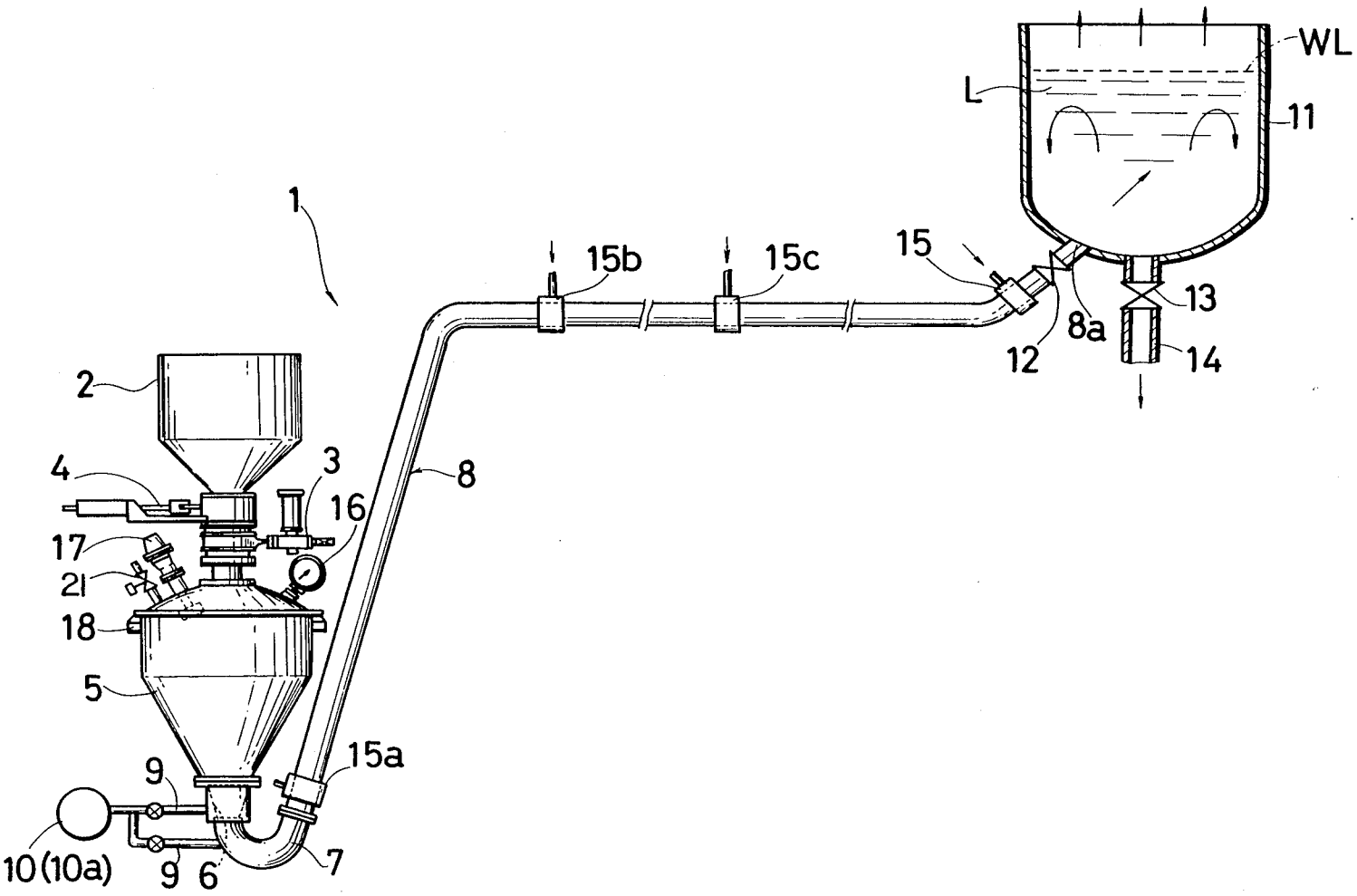
WL
11
13
14
8a
12
L
15
15c
15b
8
1
3
16
15a
7
6
9
9
2
4
17
21
18
5
10(10a)

MIXING APPARATUS FOR POWDERED OR GRANULAR MATERIALS

This is a continuation-in-part of application Ser. No. 620,154, filed June 13, 1984, now abandoned.

BACKGROUND OF THE INVENTION

1. Field of the Invention

The present invention relates to a mixing or blending arrangement and more particularly, to a mixing apparatus used, for example, for dispersing and mixing coating agents such as calcium carbonate, kaolin and the like into water as a solvent in a paper manufacturing process, or for dispering and mixing a granular component such as dextrose and the like into distilled water as a solvent in a manufacturing process of Ringer's solution, or for dispersing and mixing powdered or granular materials into solvents in other food article manufacturing processes.

2. Prior Art

Conventionally, a mixing apparatus of the type described above used an arrangement in which a downwardly directed pipe supplying the powdered or granular materials (referred to merely as granular materials hereinafter) positioned above the liquid surface in the mixing tank containing the solvent discharges the granular materials to be mixed (or dissolved) onto the liquid surface of the solvent for subsequent stirring.

The prior art mixing apparatus described above, however, has the disadvantage that the granular material discharged from the supply pipe tend to concentrate in the upper portion of the mixing tank during agitation before they dissolve into the solvent. This results not only in an unsanitary appearance, but in soiling of the peripheral portions of the mixing tank or formation of undissolved powder lumps (flocs) by the granular materials floating on the surface of the solvent. Accordingly, a long time is required for the removal of such flocs, with a concomitant loss of energy. There is also an undesirable tendency for wet solids to adhere to the periphey of the supply port of the granular material supply pipe. Moreover, for an efficient dispersion of the granular materials into the solvent, it is necessary to increase the surface area of the granular materials for better contact with the solvent. Therefore, the granular materials must be discharged into the solvent little by little in limited small amounts, which is another undesirable feature of such an apparatus.

In order to eliminate the disadvantages described so far, for example, the concentration or non-uniform mixing of the granular materials, there has been proposed, in the Japanese Patent Publication Sho No. 43 (1968)-6260, a method of adding and mixing a fine powdered material into a liquid in which a porous plate or dispersing unit including filters is provided in a vacuum-resistant mixing apparatus. A fine powdered material supply port is opened in the lower part of the dispersing unit, while the liquid is supplied to the upper portion of the porous plate, and the fine powdered material is drawn into the liquid through the fine powdered material supply port, with the interior of the mixing apparatus main body maintained under a vacuum for dispersion and mixing.

In the arrangement described above, the fine powdered material is drawn from the lower part of the dispersing unit to the upper part by air suction created by a vacuum pump. This results in increased air flow, causing deterioration in quality depending on the physical properties of the fine powdered material, and accordingly, the method as described so far has the disadvantage that it is not suitable for general purposes. Moreover, in the arrangement described above it is necessary to provide a special means (for example, installation of a baffle plate within the apparatus main body or mounting of a collecting unit on the vacuum system piping) to prevent the fine powdered material from entering the interior of the vacuum pump through the vacuum system piping. Furthermore, since the interior of the mixing apparatus is at a reduced pressure, one must provide a sealed construction to avoid any leakage of air from the main body of the mixing apparatus. In addition, since the fine powdered material is drawn into the interior of the main body of the mixing apparatus by the air suction created by the vacuum pump, it may be possible to provide a plurality of mixing apparatuses for dispersion mixing of fine powdered material; but in such a case, complicated piping is required, with a consequent increase in cost. Moreover, there is the disadvantage that transporting the fine powdered material over a long distance for its mixing in the main body of the mixing apparatus requires a large-sized vacuum pump and system which is uneconomical in practice.

SUMMARY OF THE INVENTION

Accordingly, a primary object of the present invention is to provide an improved mixing apparatus for powdered or granular materials which is capable of substantially eliminating all the drawbacks and disadvantages inherent in the conventional mixing apparatuses described above.

In order to achieve this object, the mixing apparatus for powdered or granular materials according to the present invention comprises a pneumatic conveyor means composed at least of a pressure vessel for accommodating the granular materials therein for pressurization, a granular material transport pipe issuing from the discharge portion of the pressure vessel, a pneumatic force source for feeding the granular material under pressure, and a solvent mixing tank. The discharge end of the granular material transport pipe is connected in an upward or lateral direction to the mixing tank at a point below the surface of the solvent in the mixing tank.

The features of the mixing apparatus of the present invention described so far enable various functions and effects to be achieved.

Specifically, in the mixing apparatus of the present invention the pneumatic conveyor or transport unit for the granular materials is connected to the mixing tank, and the discharbe end of the granular material transport pipe of said conveyor unit is connected to the mixing tank at a point below the liquid surface of the solvent in the mixing tank. The granular material is thus fed under pressure into the solvent in the mixing tank by the pressurized gas from the pneumatic force source for dispersion and mixing. This prevents the granular material from concentrating in the upper portion of the mixing tank and produces a sanitary process. Also, the dispersion of the granular material in the solvent by convection due to the transport pressure of the pressurized feeding gas provides uniform mixing and prevents the formation of undissolved powder lumps or flocs.

The mixing apparatus according to the present invention is capable of transporting and dispersing the granular materials, with a smaller air flow compared with the conventional mixing tanks of the vacuum (suction) type, and therefore, the reduction in quality due to physical properties of granular materials can be advantageously prevented. Furthermore, because it is not necessary to provide a special means (such as a baffle plate, collecting unit, etc.) to prevent the granular materials from entering the interior of the vacuum pump, the number of component parts is reduced, and washing of the mixing tank for cleaning is simplified and facilitated, thus reducing the maintenance costs.

Furthermore, according to the present invention, a plurality of mixing tanks may be connected to the transport pipe by a manifold which distributes the granular materials from the pressure vessel to the individual mixing tanks for dispersion and mixing in each tank.

Additionally, since gas under high pressure can be employed for increased transport energy, it becomes possible to effect high-density transportation over long distances.

Another advantage of the present invention is that the upper portion of the mixing tank may be opened or closed during use. If the open configuration is adopted, it is not necessary to be concerned about gas (e.g., air) leakage, in contrast to the sealed mixing tank in the conventional arrangement. When the closed configuration is employed, entry of foreign matter into the mixed liquid within the mixing tank is prevented.

Other objects of the present invention will become obvious upon an understanding of the illustrative embodiments about to be described or will be indicated in the appended claims, and various advantages not referred to herein will occur to one skilled in the art upon reducing the invention to practice.

BRIEF DESCRIPTION OF THE DRAWING

The attached drawing shows one preferred embodiment of a mixing apparatus for powdered or granular materials according to the present invention, in a schematic, partly sectioned, front elevational view.

DETAILED DESCRIPTION OF THE INVENTION

Referring now to the drawing, a preferred embodiment according to the present invention will be described.

In the drawing, there is shown a pneumatic conveyor arrangement 1 for transporting granular materials such as calcium carbonate, kaolin, etc. The pneumatic conveyor arrangement 1 has for its main constituents a supply hopper 2 for charging the granular materials thereinto; a pressure tank or pressure vessel 5, attached to the lower portion of the supply hopper 2 having a pressurization shut-off valve 3 and a shutter 4 actuated after the tank 5 has been charged with the proper amount of granular materials; a connecting pipe 7 attached to the lower portion of the pressure vessel 5 and internally fitted with a funnel-shaped filter 6; a granular material transport pipe 8 connected at its lower end to the connecting pipe 7; and a compressor 10*a* connected to the upper portion of the connecting pipe 7 through branch pipes 9 functioning as a source 10 of pneumatic force for feeding the granular materials under pressure. More specifically, the pneumatic conveyor arrangement 1 employs the compressor 10*a* to supply compressed air for pressure feeding the granular material from the supply hopper 2 through the transport pipe 8.

The discharge end 8*a* of the transport pipe 8 is connected through a check valve 12 to a mixing tank 11 at a point below the liquid level or surface WL of the tank 11 containing therein a solvent L such as water, distilled water, etc., but not to the center part of the bottom of the mixing tank 11 in this embodiment. The transport pipe discharge end 8*a* is directed upward with respect to the solvent L, while at the center of the bottom part of the mixing tank 11 there is mounted a discharge pipe 14 with a discharge valve 13 for discharging the mixed granular materials. The check valve 12 prevents counter-flow of solvent L from the mixing tank 11 through the transport pipe 8.

It is to be noted here that, since the outlet at the discharge end 8*a* is directed towards the central portion of the mixing tank 11, the granular material discharged from the outlet is diffused upward as in a waterspout for convection, and this ensures that the granular material is sufficiently dispersed and mixed into the solvent. However, the construction is not limited to the above embodiment, but may be so modified, for example, that the transport pipe 8 is extended into the mixing tank 11, with its discharge end 8*a* folded into a fish hook-like configuration, thereby to discharge the granular material upward from the central portion of the inner bottom part of the mixing tank 11. The construction may further be modified, for example, so that the granular material is supplied from a laterial (horizontal) direction, slantwise direction or tangential direction, etc. Furthermore, it may be so arranged that the check valve 12 and the discharge valve 13 are associated with each other in their action, whereby, for example, discharge valve 13 is automatically closed during the flow of the granular material from the discharge end 8*a*, but is automatically opened upon termination of mixing operations within the mixing tank 11.

On the transport pipe 8 at a point closer to its lower end than the location of the check valve 12 mounted in the vicinity of the discharge end 8*a*, there is provided a pressure (or booster) nozzle 15 to maintain a proper gas pressure head for mixing the granular material into the mixing tank 11 from the discharge end 8*a* and thus the undesirable counter-flow of liquid from the interior of the mixing tank is prevented, while adequate dispersion and mixing of the granular material within the mixing tank is advantageously effected.

In this embodiment, besides the pressure nozzle 15 described above, there are further provided a plurality of pressure nozzles 15*a*, 15*b*, 15*c* . . . and so forth, at specified intervals on the transport pipe 8 supplying compressed air from the compressor 10*a* and also for preventing clogging by the granular material.

There is further provided a pressure gauge 16 with a contact switch on the pressure vessel 5, and the check valve 12 is arranged to be automatically opened or closed by the pressure detected by pressure gauge 16.

For the pressure gauge 16 with a contact switch a three-contact type is employed in the illustrated embodiment. Under this pressure gauge the following actions are effected:

(1) By opening the supply hopper 2 a desired amount of granular material is supplied. Then, the hopper is closed, and a gas (air) is filled in the pressure vessel 5 until the pressure becomes equal to or exceeds the predetermined medium value, where the check valve 12 is opened. At the same time a pressurized gas is supplied through the bypass (pressure line), so as to prevent the granular material from returning into the transport pipe 8 through the check valve 12. In this way the supply of granular material into the tank 11 is secured;

(2) When the amount of granular material in the pressure vessel 5 falls below the predetermined value, and the pressure therein lowers below the lower limit, the delay timer works for indicating the completion of the transportation, and after the set time has expired, the check valve 12 is closed. After the closure of the value 12 is confirmed, the electromagnetic valves for the transport and the pressure lines are respectively closed to stop the supply of gas. At the same time the exhaust valve is opened to allow the internal pressure in the vessel 5 to release;

(3) When the pressure in the vessel 5 lowers below zero, the hopper 2 is opened, and the above-mentioned procedure is repeated.

Meanwhile, an upper limit level gauge 17 also provided on the pressure vessel 5 is associated with the valve 3 and the shutter 4. Thus, supply of the granular material is suspended by the action of the upper limit level gauge 17, while the pressure gauge 16 with the contact switch detects that the pressure vessel 5 has been emptied of its granular material, and then causes the supply of granular material to resume. Moreover, a load cell 18 is mounted on the upper side wall of the pressure vessel 5, to weigh the proper amount of granular material into the pressure vessel 5.

In the above embodiment, although compressed air is employed as a pressurized feeding gas for pneumatic force source, such compressed air may be replaced by another gas such as nitrogen, argon or the like which is suited to the granular materials to be transported.

Hereinbelow, the functioning of the mixing apparatus according to this embodiment will be described.

After tightly closing the pressure vessel 5 containing the proper amount of granular material, the compressed gas at a predetermined rate is fed from the compressor 10*a* to the connecting pipe 7 through the branch pipe 9, creating an internal pressure within the pressure vessel 5, while in the transport pipe 8, the granular material is transferred to its discharge end 8*a*. Should the transport pressure of the granular material be lowered, auxiliary pressure gas may be supplied from the pressure nozzles 15*a*, 15*b* and 15*c* . . . and so forth. More specifically, the granular material is fed into the mixing tank 11 through the discharge end 8*a* of the transport pipe 8 via the check valve 12 which is adapted to open in association with the pressure gauge 16 for detecting a rise in transport pressure. The granular material fed into the mixing tank 11 is brought into contact with the solvent L in tank 11 by the pressurized gas (compressed gas) and so subjected to convection and diffusion for effectively enhancing dispersion and mixing.

In the above case, the compressed gas fed under pressure through the discharge end 8*a* is directed toward the upper portion of the mixing tank 11 which is open to the atmosphere above the liquid level WL of the solvent L. Also, the transport pressure of the granular material exceeds the water pressure head at the lower portion of the mixing tank 11, so as to prevent entry of the solvent L into the transport pipe 8 during transport of the granular material into the mixing tank 11.

In the case where the stirring and mixing between the granular material and the solvent L in the mixing tank 11 cannot be sufficiently effected by the pressurized (compressed) gas of only the compressor 10*a*, the auxiliary pressurized gas of the nozzle 15 mounted in the vicinity of the check valve 12 may also be utilized, and when this is still insufficient for the purpose, the auxiliary pressurized gas of the other pressure nozzles 15*a*, 15*b*, 15*c* . . . and so forth, may further be utilized as described previously. It is to be noted here that a stirring means (not particularly shown) may be provided in the mixing tank 11 for a still further improvement of the stirring and mixing actions.

When the mixed liquid subjected to the dispersion and mixing in the mixing tank 11 has reached a predetermined amount, the mixed liquid is discharged by opening the discharge valve 13 through the discharge pipe 14 into a receiving container (not shown) or the like. When all the granular material in the pressure vessel 5 has been transported, the internal pressure of the pressure vessel 5 is lowered; therefore, the check valve 12 is closed in association with the pressure gauge 16 which detects such a pressure reduction to prevent counterflow of the solvent L from the mixing tank 11. Subsequently, the empty state of the pressure vessel 5 is detected by the pressure switch (not shown) to open the valve 3 and the gate valve 4 for filling the pressure vessel 5 with the next load of granular material from the supply hopper 2; the upper limit level gauge 17, determines the proper amount of charge for vessel 5. In continuous operation, all these processes are repeated.

It should be noted here that the pneumatic conveyor arrangement 1 of the present invention in which the gas pressure of the pneumatic force source 10 pressurizes the pressure vessel 5, as well as causes the flow of granular material into the solvent L in the mixing tank 11 through the transport pipe 8, should preferably be in the form of a high mixing-ratio pneumatic transport device through employment, for example, of a plug type pneumatic conveyor system or the like.

We claim:

1. An apparatus for mixing and dispersing powdered or granular materials into a liquid solvent with a pneumatic transport means comprising:

a supply hopper;

a pressure vessel which receives granular materials from the hopper for pressurization;

a granular material transport pipe attached at one end to the discharge portion of said pressure vessel;

a pneumatic force source for feeding the granular materials under pressure through said granular material transport pipes;

a mixing tank for accommodating the liquid solvent therein attached to the other end of said granular material transport pipe, said granular material transport pipe being connected to said mixing tank in an upward direction of a point below the surface of said liquid solvent contained in said mixing tank;

a check valve for preventing a counter-flow of the liquid solvent out of said mixing tank, said check valve being located in said transport pipe, but at a point near the connection thereof to said mixing tank;

a cyclic filling and emptying system including a gate valve controlling the supply of granular material from said supply hopper, a pressure switch sensing the pressure in said pressure vessel, and an upper limit level gauge, wherein said gate valve, pressure switch and upper limit level gauge work in cooperation; and said check valve being connected to said pressure switch so that said check valve is opened or closed in accordance with the internal pressure in said pressure vessel.

2. The apparatus of claim 1, further comprising at least one pressure nozzle provided on said granular material transport pipe upstream from said check valve.

3. The apparatus of claim 1, wherein said pneumatic force source comprises an air or gas compressor with one set of high-pressure discharge lines, connected to the pressure vessel and another set to the granular material transport pipe near its attachment to the pressure vessel.

4. The apparatus of claim 1, wherein said pressure vessel further comprises a cyclic filling and emptying system consisting of a gate valve controlling the admission of granular materials from the supply hopper, a pressure switch sensing pressure in the vessel, and an upper limit level gauge, all acting in cooperation.

5. The apparatus of claim 1, wherein the mixing tank is open to the atmosphere.

6. An apparatus for mixing or dispersing powdered or granular material into a liquid solvent with a pneumatic transport means comprising:

a supply hopper;

a pressure vessel which receives granular materials from the hopper for pressurization, said pressure vessel comprising a cyclic filling and emptying system comprising a gate valve controlling the admission of granular materials from the supply hopper, a pressure switch sensing pressure in the vessel, and an upper limit gauge, all acting in cooperation;

a granular material transport pipe attached at one end to the discharge portion of said pressure vessel;

a pneumatic force source for feeding the granular materials under pressure through said granular material transport pipe, said pneumatic force source comprising an air or gas compressor with one set of high-pressure discharge lines connected to the pressure vessel and another set to the granular material transport pipe near its attachment to the pressure vessel;

a mixing tank for accommodating a liquid solvent therein attached to the other end of said granular material transport pipe, said granular material transport pipe being connected to said mixing tank in an upward direction at a point below the surface of the liquid solvent contained in the tank;

a check valve in the granular material transport pipe in the vicinity of its attachment to said mixing tank for preventing counter-flow of the liquid solvent out of said mixing tank; and at least one pressure nozzle provided on said granular material transport pipe upstream from said check valve.

* * * * *